United States Patent [19]

Ojiri et al.

[11] 4,131,539

[45] Dec. 26, 1978

[54] REMOVING RUTILE FROM ZIRCON ELECTROSTATICALLY

[75] Inventors: Kozo Ojiri, Kamakura; Kohzo Sakai, Tokyo, both of Japan

[73] Assignee: Asahi Glass Company Limited, Tokyo, Japan

[21] Appl. No.: 772,141

[22] Filed: Feb. 25, 1977

[30] Foreign Application Priority Data

Mar. 5, 1976 [JP] Japan ..... 51/23140

[51] Int. Cl.[2] ..... B03C 7/00

[52] U.S. Cl. ..... 209/127 A; 209/11; 423/73; 423/80

[58] Field of Search ..... 423/80, 81, 73; 209/127 R, 127 A, 127 B, 127 C, 128, 129

[56] References Cited

U.S. PATENT DOCUMENTS

| | | | |
|---|---|---|---|
| 959,646 | 5/1910 | Swart | 209/127 A |
| 2,180,804 | 11/1939 | Fahrenwald et al. | 209/127 A |
| 2,187,637 | 1/1940 | Sutton et al. | 209/129 |
| 2,954,278 | 9/1960 | Gaskin et al. | 423/80 |
| 3,137,648 | 6/1964 | Fraas | 209/127 R X |

OTHER PUBLICATIONS

"Electrostatic Separation of Granular Materials," Bull. 603, Bureau of Mines (F. Fraas), 1962, p. 102, U.S. Dept. of Int.

Bureau of Mines, Report of Investigations 5213, Apr. 1956 (F. Fraas), pp. 12–15, U.S. Dept. of Interior.

*Primary Examiner*—Brian Hearn

*Attorney, Agent, or Firm*—Oblon, Fisher, Spivak, McClelland & Maier

[57] ABSTRACT

Titanium dioxide component is removed from a mineral containing titanium dioxide component which is difficult to be separated by the conventional electrostatic separation.

In the electrostatic separation from the mineral containing titanium dioxide component, the mineral is pretreated by a heat-treatment in an atmosphere of reducing, neutral or inert gas or a mixture thereof so as to change the electrostatic property of titanium dioxide and separating by an electrostatic separation.

6 Claims, No Drawings

REMOVING RUTILE FROM ZIRCON ELECTROSTATICALLY

BACKGROUND OF THE INVENTION

Field of the Invention

The present invention relates to a method of removing titanium dioxide component from a mineral containing titanium dioxide component. More particularly, it relates to a method of removing titanium dioxide from a mineral containing titanium dioxide component such as zircon sand by an electrostatic separation.

Description of the Prior Art

It has been difficult to separate titanium dioxide component from zircon as typical mineral containing titanium dioxide component by various conventional methods, though the separation has been needed. Accordingly, the separation of titanium dioxide from zircon will be mainly illustrated. The method of the invention is also effective for the other cases such as the separation of titanium dioxide component from baddeleyite and other minerals containing titanium dioxide component.

Zircon is one of the source of $ZrO_2$ which is commercially used as well as baddeleyite. Zircon and baddeleyite have been widely used in the fields of refractories, sand for casting, enamels, metallurgy and glass manufactures.

Thus, high grade of zircon is required in the field of refractories. However, it has been difficult to supply the first grade zircon in stable for a long period in high yield.

It has been usual to employ a gravity concentration, a magnetic separation or an electrostatic separation (high tension separation) in order to separate zircon from zircon sand. However, zircon sand contains impurities of rutile ($TiO_2$), monazite {(Ce, La, Th) $PO_4$} and ilmenite ($FeTiO_3$). Accordingly, it is necessary to separate the impurities by utilizing the differences of gravity and magnetic characteristic.

However, rutile has similar gravity and magnetic characteristic to those of zircon as the object mineral whereby it has been difficult to separate rutile by the gravity concentration or the magnetic separation. It has been usual to separate rutile by the high tension separation under utilizing the difference of dielectric constant thereof. However, the latter method has not been substantially satisfied. It has been usual to treat the mineral by various methods to obtain the first grade zircon ($Fe_2O_3 < 0.1$ wt.%; $TiO_2 < 0.1$ wt.%) under losing the yield of zircon.

The method of the invention has been found after various method of mineral dressings having high efficiency.

SUMMARY OF THE INVENTION

It is an object of the present invention to provide a method of removing titanium dioxide component from a mineral in high efficiency to obtain high grade product in high yield.

The object of the invention has been attained by providing a method of removing titanium dioxide component from a mineral containing titanium dioxide component by heat-treating the mineral in an atmosphere of reducing, neutral or inert gas to reduce the valency of titanium before an electrostatic separation.

DETAILED DESCRIPTION OF THE PREFERRED EMBODIMENTS

In the specification, the mineral containing titanium dioxide component means a source including a mineral containing titanium dioxide component. Typical minerals containing titanium dioxide component include zircon sand, baddeleyite, etc.

The titanium dioxide in zircon sand is rutile type, however, it is also possible to remove anatase type or brookite type titanium dioxide.

In accordance with the method of the present invention, titanium dioxide component can be effectively separated from the mineral containing titanium dioxide component in high yield, especially zirconium compound having high purity can be obtained from zircon sand in high yield.

In the method of the invention, it is preferable to employ the high tension separation wherein the separation is carried out by utilizing the difference of conductivities of the surfaces of the minerals charged by corona discharge from an electrode in high potential.

It is also preferable to employ the conventional electrostatic separation wherein the mineral is passed through an electric field having potential difference of up to about 20,000 volts ahd high dielectric flux density gradient to separate the mineral by utilizing the difference of dielectric constant.

In the specification, the electrostatic separation means both of the high tension separation and the conventional electrostatic separation.

The separation can be carried out in various conditions when the heat-treatment is previously given in the reducing condition.

It is enough to cause corona discharge so as to adhere zircon on the rotor of an electrostatic separator. The effective separation can be accomplished for example in a separator manufactured by Carpco Co., in the conditions of a voltage of 10,000 to 50,000 volts especially 25,000 to 35,000 volts, a distance from the rotor to the main electrode of 1 to 15 cm, especially 4 to 8 cm, an angle of the main electrode of 40 to 60 degree, a distance from the rotar to an auxiliary electrode of 3 to 5 cm, an angle of the auxiliary electrode of 10 to 30 degree, a revolution velocity of the rotor of about 50 to 300 rpm.

The method of the invention is further illustrated in detail.

In the method of the invention, the mineral such as zircon sand is heat-treated in an atmosphere of reducing, neutral or inert gas or a mixture thereof to reduce the valence of titanium before the electrostatic separation.

The atmosphere in the heat-treatment is a reducing, neutral or inert gas atmosphere or a mixture thereof. No effect is found by the heat-treatment in an oxidizing atmosphere containing free oxygen. The reducing atmosphere contains hydrogen or carbon monoxide. The neutral atmosphere contains carbon dioxide, methane, propane, etc.. The inert atmosphere contains nitrogen, argon, etc..

The optimum atmosphere in an industrial operation include a nitrogen gas atmosphere, a reducing atmosphere containing CO and/or $H_2$ under an incomplete combustion such as an atmosphere formed by imcomplete combustion of city gas or water gas, and a neutral atmosphere containing $CO_2$.

In the invention, the temperature in the heat-treatment is dependent upon the atmosphere and the time for the heat-treatment. In usual, the temperature is preferably at higher than 400° C. for a calcination in the nitrogen gas atmosphere, and it is preferably in a range of 400° to 700° C. in the $CO_2$ gas atmosphere.

It is possible to calcine zircon sand with carbon. In this case, the temperature is at higher than 800° C.

In the strong reducing atmosphere containing CO, etc., the temperature in the heat-treatment can be lower such as about 300° C. or lower, in usual, it is preferably in a range of 400° to 800° C.

The condition of the heat-treatment can be decided so as to cause the change of electrostatic property of titanium dioxide in the atmosphere not to electrostatically deposite on an electrode.

The reason of the effect of the heat-treatment is not always clear. Thus, it is considered to cause the phenomenona of increasing electric conductivity by converting $TiO_2$ to $TiO_{2-x}$ wherein x is less than 1. (oxygen defects)

The surface of titanium dioxide is converted to $TiO_{2-x}$ by the heat-treatment in the specific atmosphere whereby the special result in the separation can be attained.

In accordance with the method of the invention, titanium dioxide component can be separated from the mineral containing titanium dioxide component in high efficiency and high yield, especially zirconium compound having high purity can be obtained in high yield. The industrial value is remarkably high.

The invention will be further illustrated by certain examples.

EXAMPLE 1

The formula of zircon sand used in the separation was as follows. (wt. percent)

| $ZrO_2$ | $SiO_2$ | $Fe_2O_3$ | $TiO_2$ | $SnO_2$ | $HPO_2$ |
|---|---|---|---|---|---|
| 64.6 | 31.9 | 0.06 | 1.01 | 1.06 | 0.30 |

The zircon sand was heated in a tubular electric furnace passing nitrogen gas at a rate of 200° C. per hour to the temperature shown in Table 1 (maintained for 1 hour), and then was cooled without any forcible cooling and then the treated zircon sand was passed through high tension separator at a rate of 100 g/min..

The separator is as follows.

Manufactured by Carpco Co.

Voltage: 30 KV(−)

Distance from main electrode-rotor: 60 mm

Distance from auxiliary electrode-rotor: 30 mm

Diameter of rotor: 260 mm

Revolution velocity of rotor: 100 r.p.m.

The results are shown in Tables 1 and 2 wherein the results of the separation without the pretreatment are as follows.

Table 1

| Temperature in heat-treatment | Analysis of concentrates in the first high tension separation (wt. percent) | | | | | | | |
|---|---|---|---|---|---|---|---|---|
| | $ZrO_2$ | $SiO_2$ | $Fe_2O_3$ | $TiO_2$ | $SnO_2$ | $HfO_2$ | Total | Yield (%) |
| Non-treatment | 65.0 | 32.3 | 0.05 | 0.56 | 0.13 | 0.54 | 98.58 | 97.3 |
| 400° C | 66.4 | 32.4 | 0.06 | 0.16 | 0.09 | 0.76 | 99.94 | 95.9 |
| 500° C | 67.0 | 33.0 | 0.06 | 0.08 | 0.07 | 0.41 | 100.62 | 95.0 |
| 600° C | 66.0 | 32.1 | 0.05 | 0.10 | 0.06 | 0.39 | 98.90 | 95.9 |
| 800° C | 66.0 | 32.0 | 0.06 | 0.11 | 0.10 | 0.39 | 98.06 | 95.9 |
| 1000° C | 67.0 | 33.1 | 0.03 | 0.13 | 0.05 | 0.45 | 100.76 | 95.4 |

Table 2

| Temperature in heat treatment | Analysis of concentrates in the second high tension separation (wt. percent) | | | | | | | |
|---|---|---|---|---|---|---|---|---|
| | $ZrO_2$ | $SiO_2$ | $Fe_2O_3$ | $TiO_2$ | $SnO_2$ | $HfO_2$ | Total | Yield (%) |
| Non-treatment | 65.2 | 33.1 | 0.06 | 0.34 | 0.08 | 0.62 | 99.40 | 95.6 |
| 400° C | 66.5 | 32.6 | 0.07 | 0.08 | 0.04 | 0.47 | 99.76 | 94.8 |
| 500° C | 67.0 | 33.0 | 0.06 | 0.03 | 0.02 | 0.39 | 100.5 | 94.0 |
| 600° C | 66.8 | 32.2 | 0.05 | 0.03 | 0.03 | 0.41 | 99.82 | 94.3 |
| 800° C | 66.5 | 32.1 | 0.05 | 0.04 | 0.05 | 0.42 | 99.36 | 94.5 |
| 1000° C | 66.9 | 32.6 | 0.04 | 0.03 | 0.02 | 0.52 | 100.09 | 94.0 |

EXAMPLE 2

The formula of zircon sand used in the separation was as follows. (wt. percent)

| $ZrO_2$ | $SiO_2$ | $Fe_2O_3$ | $TiO_2$ | $SnO_2$ | $HfO_2$ |
|---|---|---|---|---|---|
| 65.7 | 33.7 | 0.10 | 1.0 | 0.17 | 0.50 |

The zircon sand was heated in a tubular electric furnace passing $CO_2$ gas at the specific temperature for 1 hour and then was gradually cooled and then the treated zircon sand was passed through the high tension separator of Example 1.

The results are shown in Table 3.

Table 3

| Temperature in heat-treatment | $ZrO_2$ | $SiO_2$ | $Fe_2O_3$ | $TiO_2$ | $SnO_2$ | $HfO_2$ | Total | Yield (%) |
|---|---|---|---|---|---|---|---|---|
| 600° C | 66.0 | n.d. | 0.06 | 0.02 | n.d. | n.d. | — | 94.0 |

Table 3-continued

| Temperature in heat-treatment | $ZrO_2$ | $SiO_2$ | $Fe_2O_3$ | $TiO_2$ | $SnO_2$ | $HfO_2$ | Total | Yield (%) |
|---|---|---|---|---|---|---|---|---|
| 800° C | 66.4 | n.d. | 0.08 | 0.48 | n.d. | n.d. | — | 97.8 |

EXAMPLE 3

The zircon sand of Example 2 was respectively calcined at 600° C. in a rotary kiln through which a combustion gas containing $H_2O$, $CO_2$, CO and $N_2$ which was produced by a combustion of the city gas with shortage of oxygen.

The time for calcination is shown in Table 4. The treated zircon sand was passed through the high tension separator of Example 1. The results are shown in Table 4. (wt. percent).

Table 4

| Time for calcination | $ZrO_2$ | $SiO_2$ | $Fe_2O_3$ | $TiO_2$ | $SnO_2$ | $HfO_2$ | Total | Yield (%) |
|---|---|---|---|---|---|---|---|---|
| 1 min. | 66.4 | n.d. | 0.09 | 0.04 | n.d. | n.d. | — | 94.5 |
| 3 min. | 66.0 | n.d. | 0.09 | 0.06 | n.d. | n.d. | — | 95.6 |
| 12 min. | 67.0 | n.d. | 0.10 | 0.01 | n.d. | n.d. | — | 95.0 |

EXAMPLE 4

The zircon sand of Example 2 was charged in a crucible and carbon powder was put on it to cover the surface and the crucible was heated in a tubular electric furnace in air for 1 hour. The treated zircon sand was passed through the high tension separator of Example 1. The results are shown in Table 5 (wt. percent).

Table 5

| Temperature in heat-treatment | $ZrO_2$ | $SiO_2$ | $Fe_2O_3$ | $TiO_2$ | $SnO_2$ | $HfO_2$ | Total | Yield (%) |
|---|---|---|---|---|---|---|---|---|
| 500° C | 66.5 | n.d. | 0.07 | 0.11 | n.d. | n.d. | — | 96.8 |
| 800° C | 67.0 | n.d. | 0.06 | 0.01 | n.d. | n.d. | — | 96.0 |

What is claimed is:

1. A method for removing rutile from zircon sand containing titanium dioxide on the order of one percent, said titanium dioxide being present in the sand at least in part as rutile, which comprises heat treating said zircon sand in a non-oxidizing atmosphere so as to change the electrostatic property of the rutile and removing the rutile from said heat treated sand by an electrostatic separation in an amount sufficient to reduce the titanium dioxide content of the sand to not more than about 0.1 wt.% $TiO_2$, said heat treatment being at a temperature greater than 400° C.

2. A method according to claim 1, wherein said electrostatic separation is a high tension separation.

3. A method according to claim 1, wherein said mineral containing titanium dioxide component is heat-treated in a nitrogen gas atmosphere.

4. A method according to claim 1, wherein the temperature in the heat-treatment is in a range of 400° C. to 800° C.

5. A method according to claim 1, wherein said mineal containing titanium dioxide component is heat-treated in a reducing atmosphere containing CO or $H_2$ before the electrostatic separation.

6. A method according to claim 1, wherein said mineral containing titanium dioxide component is heat-treated in a neutral atmosphere containing $CO_2$ at 400° C. to 750° C. before the electrostatic separation.

* * * * *